United States Patent [19]

Grass

[11] 4,131,968

[45] Jan. 2, 1979

[54] REINFORCED HINGE WITH ADJUSTABLE TIGHTENING MEANS

[76] Inventor: Alfred Grass, Konsumstrasse 20, Hoechst, Austria, A-6973

[21] Appl. No.: 844,217

[22] Filed: Oct. 21, 1977

[51] Int. Cl.[2] ..... E05D 7/04

[52] U.S. Cl. ..... 16/129; 16/130

[58] Field of Search ..... 16/129–134

[56] References Cited

U.S. PATENT DOCUMENTS

| | | | |
|---|---|---|---|
| 3,772,735 | 11/1973 | Lautenschlaeger | 16/129 |
| 3,977,042 | 8/1976 | Lautenschlaeger | 16/130 |
| 4,045,841 | 9/1977 | Rock et al. | 16/129 |

FOREIGN PATENT DOCUMENTS

| | | | |
|---|---|---|---|
| 2101082 | 7/1971 | Fed. Rep. of Germany | 16/130 |
| 1482786 | 8/1977 | United Kingdom | 16/129 |

*Primary Examiner*—James Kee Chi

*Attorney, Agent, or Firm*—Price and Caslin

[57] ABSTRACT

An adjustable hinge arrangement between a stationary member and a movable closure member. The hinge arrangement comprises a stationary base plate supporting a sliding member that is adjustable in a direction that is perpendicular to the closure member. A hinge arm is supported from the sliding member, and the arm is adjustable in a direction that is parallel to the closure. A set screw locks the sliding member to the base plate, and an adjusting screw is interlocked with a bayonet slot in the hinge arm and is threaded into the sliding member.

5 Claims, 7 Drawing Figures

REINFORCED HINGE WITH ADJUSTABLE TIGHTENING MEANS

FIELD OF THE INVENTION

This invention relates to an adjustable hinge arrangement between a stationary member, such as a piece of furniture, and a movable closure member such as a hinged door or window.

The principal object of the present invention is to provide an adjustable hinge arrangement having a hinge arm that is connected to a base plate through a sliding member so as to have two way adjustability.

A further object of the present invention is to provide an adjustable hinge arrangement of the class described with a tongue and groove connection between the sliding member and the base plate.

A further object of the present invention is to provide an adjustable hinge arrangement of the class described with an adjusting screw interlocked with the hinge arm such as by a bayonet slot.

A still further object of the present invention is to provide the hinge arm with cut-out portions in the side walls so these side walls do not carry load to the sliding member.

SUMMARY OF THE INVENTION

The present invention relates to an adjustable hinge arrangement comprising a stationary base plate supporting an adjustable sliding member that in turn supports a hinge arm through an adjustable screw means. Pivot means joins the hinge arm to a closure member. A locking means holds the sliding member rigid with respect to the base plate. The sliding member is adjustable in a direction perpendicular to the closure, while the hinge arm is adjustable in a direction that is parallel to the closure.

BRIEF DESCRIPTION OF THE DRAWINGS

This invention will be better understood from the following description taken in conjunction with the accompanying drawings, and its scope will be pointed out in the appened claims.

DESCRIPTION OF THE PREFERRED EMBODIMENT

Figures 1, 2, 3, 4, 5, 6, 7:
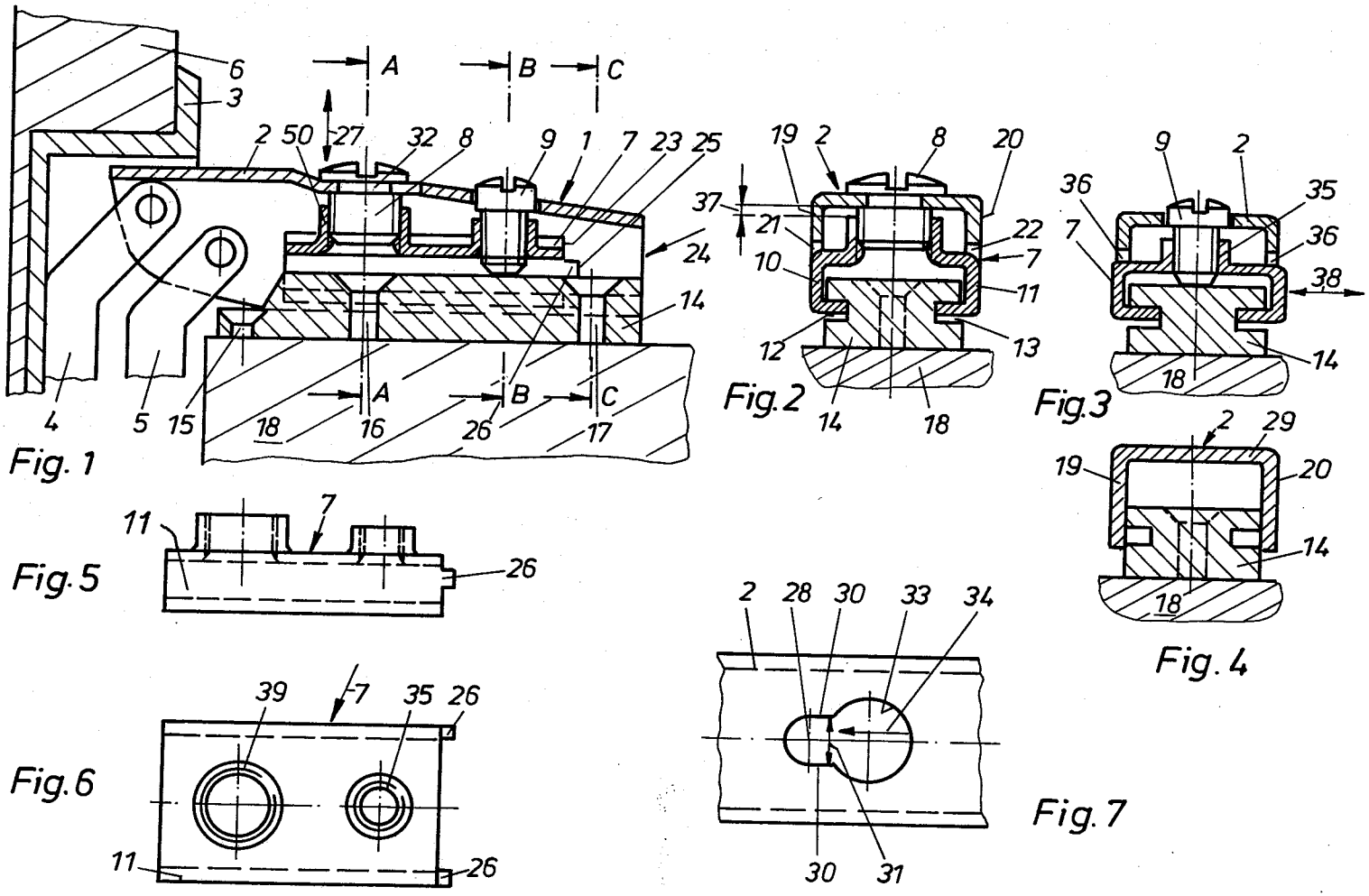
FIG. 1 is a fragmentary cross-sectional view through an adjustable hinge arrangement of the present invention, showing the hinge fastened to a side wall of a piece of furniture and supporting a door.
FIG. 2 is a transverse cross-sectional view taken on the line A—A of FIG. 1, showing the adjusting screw acting between the hinge arm and the sliding member.
FIG. 3 is a transverse cross-sectional view taken on the line B—B of FIG. 1, showing the set screw for locking the sliding member rigid with respect to the base plate.
FIG. 4 is a transverse cross-sectional view taken on the line C—C of FIG. 1, showing the close fitting relationship between the side walls of the hinge arm and the sides of the sliding member.
FIG. 5 is a front elevational view of the sliding member showing the two threaded openings in the top wall thereof.
FIG. 6 is a top plan view of the sliding member of FIG. 5.
FIG. 7 is a fragmentary top plan view, on an enlarged scale, of the top wall of the hinge arm showing the bayonet slot for cooperation with the adjusting screw.

Turning now to a description of the drawings, and in particular to FIG. 1, there is shown an adjustable hinge arrangement 1 that is adapted to be connected between a stationary support 18, such as a side wall of a piece of furniture, and a closure member, such as a door 6.

The hinge arrangement 1 comprises a stationary base plate 14 which carries an adjustable sliding member 7, which in turn carries an adjustable hinge arm 2. The door 6 is recessed on its inner side to receive a casing 3. This casing 3 is joined to the hinge arm 2 by means of hinge straps 4 and 5.

The stationary base plate 14 is a solid elongated block of metal which is fastened to the support 18 by means of screws 15, 16 and 17. Each longitudinal side wall of the base plate has a longitudinal groove 12 and 13, respectively.

FIG. 2 is a transverse cross-sectional view taken on the line A—A of FIG. 1. The adjustable sliding member 7 has a transverse cross-section of inverted U-shape with opposite side walls 10 and 11 respectively, each side wall having inwardly-turned flanges which slip into the grooves 12 and 13 respectively to form a tongue and groove connection in the broad sense of the term.

Looking at the top plan view of the sliding member 7 of FIG. 6, there are two internally threaded openings 35 and 39. Each opening 35 and 39 has a raised shoulder. The raised shoulder of opening 39 is shoulder 50, as is seen in FIG. 1. An adjusting screw 8 is threaded into the opening 39, while a set screw 9 is threaded in the opening 35.Once the position of the sliding member 7 is located, the set screw 9 is tightened down to bear upon the top wall of the base plate 14 and lock the sliding member in place. Notice that the head of the set screw 9 is exposed in an enlarged opening in the top wall 29 of the hinge arm 2.

As is clear from FIGS. 1 and 2, the hinge arm 2 is also an inverted U-shaped member in transverse cross-section. The side walls 19 and 20 of the hinge arm 2 lie substantially within the same plane as the side walls 10 and 11 respectively of the sliding member 7, as is seen in both FIGS. 2 and 3. The side wall 19 of the hinge arm 2 has a cut-out 21 which receives the side wall 10 of the sliding member 7 therein. Similarly, the side wall 20 has a cut-out 22 which receives the side wall 11 of the sliding member therein. There is enough clearance between the side walls 10 and 11 and the cut-outs 21 and 22 respectively that there is play between the sliding member 7 and the hinge arm 2 and no binding action. In the edge 23 of each cut-out 21 and 22 that is the most remote from the door 6, and is nearest the opening 24 of the hinge arm is an indentation 25. This indentation 25 is adapted to receive a stud 26 which extends from the end of each side wall 10 and 11 and together creates a swinging bearing between the sliding member 7 and the hinge arm 2.

As mentioned earlier, an adjusting screw 8 is threaded into the threaded opening 39 in the top wall of the sliding member 7. This adjusting screw 8 is also interlocked with the top wall 29 of the hinge arm 2. The top wall 29 of the hinge arm 2 has a bayonet slot 28 with a circular hole 33 that is slightly larger in diameter than the diameter of the shank of the screw 8. The bayonet slot 28 also has a narrow slot with parallel side walls 30 which are spaced from one another a distance that is less than the diameter of the head of the screw 8. Beneath the head of the screw 8 is an undercut 32 that is about the same diameter as the width 31 of the narrow slot so as to be able to slip sidewardly therein in the direction of the arrow 34, to interlock the screw 8 with the hinge arm 2. Thus when the screw 8 is turned the hinge arm 2 will move up or down as shown by arrow 27 in FIG. 1 depending upon the direction of turning of the screw. There would also be a slight swinging action between the adjustable member 7 and the movable hinge arm 2 by means of the swinging bearing 25 and 26. Of course there has to be enough clearance or play in the cut-outs 21 and 22 to permit this swinging action to take place without binding.

Looking at FIG. 3, the clearance 36 in the cut-outs 21 and 22 with the top wall of the sliding member 7 insures that the load on the hinge arm 2 will not be transmitted through its side walls 19 and 20 to the sliding member 7. Instead the load is carried through the adjusting screw 8. By comparing FIGS. 1 and 2, it will be understood that the amount of adjustment 37 of the hinge arm 2 is measured as the distance between the top of the shoulder 50 and the underside of the top wall 29 of the hinge arm 2.

As seen in FIG. 4, there is minimum clearance between the side walls 19 and 20 of the hinge arm 2 with the side walls of the base plate 14 which prevents any wobble action.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. An adjustable hinge arrangement between a stationary member and a movable closure member, said hinge arrangement comprising a stationary base plate and an adjustable sliding member carried by the base plate, an adjustable hinge arm for attachment to the sliding member, and pivot means joining the hinge arm to the closure member, the adjustable sliding member being capable of adjustment in a direction that is substantially perpendicular to the movable closure member, the adjustable hinge arm being capable of adjustment in a direction that is substantially parallel to the plane of the movable closure member, there being a tongue and groove connection between the base plate and the sliding member, and locking means between the sliding member and the base plate, the adjustable hinge arm having a transverse cross-section of inverted U-shape that encompasses the sliding member, the side walls of the hinge arm including cut-outs for loosely receiving the side portions of the sliding member therein so the load on the hinge arm is not carried by the said side walls to the sliding member, but by the said side walls to the base plate.

2. The invention of claim 1 wherein the cut-out opening in each side wall of the hinge arm has a pivot means in the edge of the opening that is the most distant from the closure member, the said sliding member having a mating pivot means that cooperates with the first pivot means to serve as a swinging bearing between the sliding member and the hinge arm.

3. The invention of claim 1 wherein the adjustable sliding member has a transverse cross-section of inverted U-shape with side walls having inwardly-turned flanges along the lower edge, the base plate having a longitudinal groove in each of the opposite side walls for receiving the flanges to form the said tongue and groove connection.

4. The invention of claim 1 wherein the top wall of the sliding member has an internally threaded opening, and the top wall of the hinge arm has a bayonet slot, and an adjusting screw locked into the bayonet slot and fitted into the threaded opening for shifting the hinge arm toward and away from the sliding member.

5. The invention of claim 4 wherein the said internally threaded opening has a raised shoulder which serves as a limit means of the movement of the hinge arm toward the sliding member.

* * * * *